United States Patent [19]

McGinley

[11] 4,285,370

[45] Aug. 25, 1981

[54] SHED RETAINER

[76] Inventor: Thomas F. McGinley, 175 Prospect St., Phillipsburg, N.J. 08865

[21] Appl. No.: 58,790

[22] Filed: Jul. 19, 1979

[51] Int. Cl.[3] ..... D03D 47/00

[52] U.S. Cl. ..... 139/11

[58] Field of Search ..... 139/11, 11 A, 329, 436

[56] References Cited

U.S. PATENT DOCUMENTS 4,122,871 10/1978 McGinley ..... 139/11 A

FOREIGN PATENT DOCUMENTS 2645302 12/1977 Fed. Rep. of Germany ..... 139/11 A

*Primary Examiner*—Henry Jaudon

*Attorney, Agent, or Firm*—Weinstein & Sutton

[57] ABSTRACT

A shed-retaining member is provided for use with a weaving loom of the type having apparatus for forming warp sheds, with the shed-retaining member being insertable between warp threads to maintain the warp sheds in an open position. The improved shed-retaining member includes protruding and enlarged release surfaces for engagement with the warp threads to more reliably release the warp threads by increasing the spacing between groups of warp threads in order to release them.

12 Claims, 11 Drawing Figures

SHED RETAINER

FIELD OF THE INVENTION

The present invention relates generally to weaving looms, and specifically to looms having shed-forming elements for elevating and depressing warp threads to form warp sheds, and shed retainers insertable between the warp threads to maintain the warp sheds as they are moved toward the fell of the fabric.

BACKGROUND OF THE INVENTION

Shed retainers are employed in multiphase or multished weaving looms which utilize multiple sheds traveling in a wave-like form in the direction of the warp threads, with each of the waves constituting a separate and distinct warp shed through which weft yarn or thread is inserted. Suitable apparatus, such as a harness mechanism, is provided for forming the warp sheds to effect preliminary spacing of the warp threads. After the warp sheds are formed, they travel in the direction of the warp threads toward the fell of the fabric. Accordingly, it is necessary to provide shed retainers for maintaining the warp sheds open as they are moved in the direction of the warp threads and while the weft thread is being inserted in the warp sheds. Reference is made to U.S. Pat. No. 4,122,871 for a complete and detailed description of such multished weaving looms.

The function of such shed retainers is to maintain the spacing between elevated and depressed warp threads when the shed retainers are in their shed-retaining position, and to release such warp threads when the shed retainer is moved to its shed-releasing position. This must be accomplished without interfering with, or interference from, the warp threads being engaged by the shed retainer. In addition, it is also necessary to move the shed retainers to their shed-releasing positions without damaging or tangling the warp threads, and to also allow the shed retainers to be withdrawn from the warp threads after the warp sheds are released.

Broadly, it is object of the present invention to provide an improved shed retainer which accomplishes the foregoing in an improved manner. Specifically, it is within the contemplation of the present invention to provide improved shed retainers which are constructed and arranged to increase the spacing between groups of the depressed warp threads so that they can be reliably released, and so that the shed retainers may be easily withdrawn from the plane of the warp and weft threads.

It is a further object of the present invention to provide an improved shed retainer which positively operates to release the warp threads when the shed retainer is moved to its shed-releasing position, and to do so smoothly and without snagging of the warp threads, and without interference with or interference from, the warp threads which are being released.

SUMMARY OF THE INVENTION

Briefly, in accordance with the principles of the present invention, an improved shed retainer is provided which is movable between a shed-releasing position and a shed-retaining position. In the shed-retaining position, an upper surface of the shed retainer is engageable with a plurality of elevated warp threads, and a lower surface of the shed retainer is engageable with a plurality of depressed warp threads. Apparatus is provided for actuating the shed-retaining member between its shed-retaining position and its release position in which the elevated and depressed warp threads are no longer engaged by the upper and lower surfaces of the shed retainer. In addition, each shed-retaining member includes an upper plate section and a lower shaft section. In the preferred embodiment, the plate section includes two planar surfaces which are each provided with elements which protrude therefrom and have outer surfaces for engaging the warp threads when they are released. The release surfaces taper inwardly toward the plate section, with the largest transverse dimension being at the lower warp thread engaging surface.

In this manner, when the shed-retaining member is actuated to its shed-releasing position, the release surface operates to increase the spacing between groups of depressed warp threads in order to release them. By increasing the spacing between these groups of warp threads to release them, the shed retainer may also be withdrawn from the plane of the warp and weft threads without damaging of the warp threads and without interference with, or interference from, the warp threads which are being released.

BRIEF DESCRIPTION OF THE DRAWINGS

Further objects, features, and advantages of the present invention will become apparent upon the consideration of the following detailed description of a presently preferred embodiment when taken in conjunction with the accompanying drawings, wherein.

DETAILED DISCUSSION OF PREFERRED EMBODIMENTS OF THE INVENTION

As explained above, the improved shed retainers of the present invention are to be employed in a multiphase or multished weaving loom which utilizes multiple sheds traveling in a wave-like form in the direction of the warp threads, with each of the waves constituting a separate and distinct warp shed through which weft yarn or thread is inserted. Reference is made to U.S. Pat. No. 4,122,871 for a complete and detailed description of such multished weaving looms.

Figure 1:
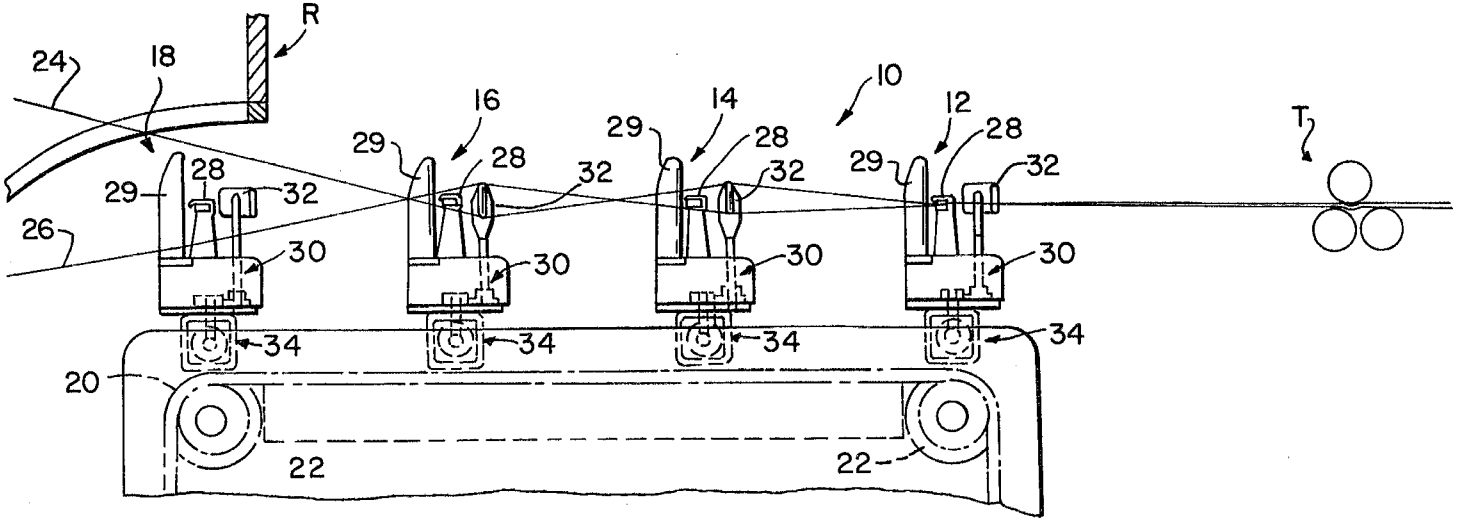
FIG. 1 is a side elevational view of a multished weaving loom incorporating the improved shed retainer of the present invention.
Figure 2:
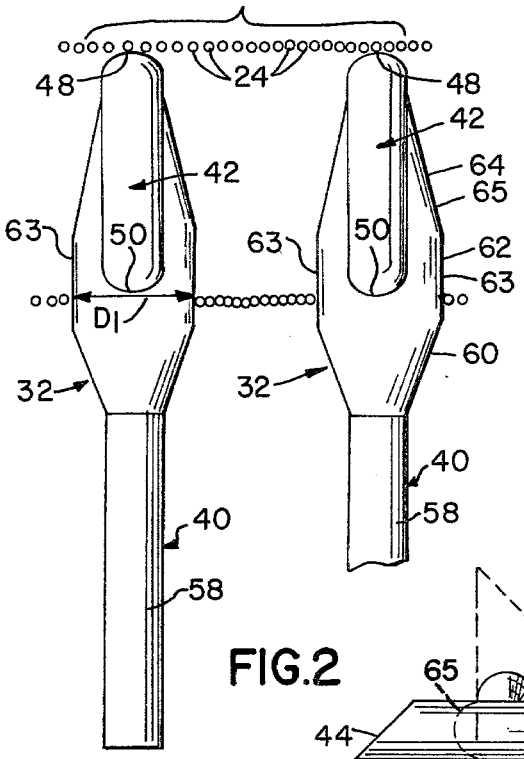
FIG. 2 is an elevational view of two shed retainers in their shed-releasing position.
Figure 4:
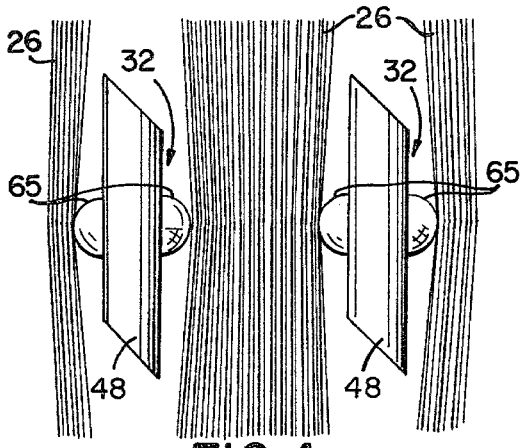
FIG. 4 is a sectional view taken on FIG. 3 of the shed retainers in their shed-releasing position.
Figure 5:
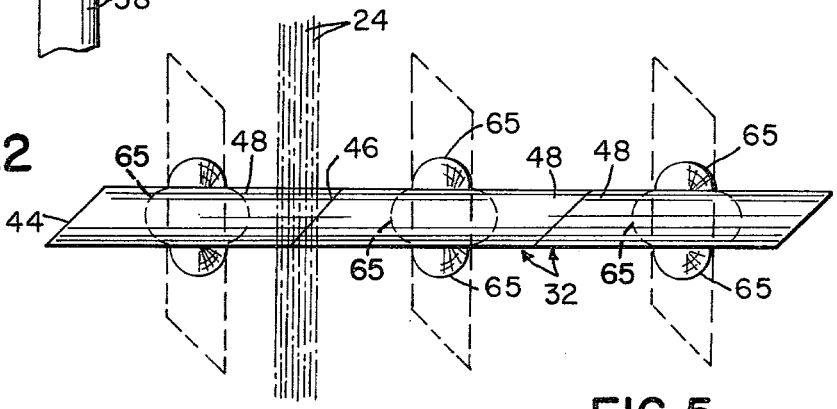
FIG. 5 is a plan view illustrating the shed retainers in their shed-retaining position in solid line and the shed retainers in their shed-releasing position in dotted line.

Referring now to FIG. 1 of the present case, it illustrates the portion of a multished weaving loom 10 which employs the improved shed retainers of the present invention. As shown therein, it includes shed-retaining stations generally indicated at 12, 14, 16, and 18. Such shed-retaining stations are mounted for movement on a chain conveyor 20 having sprockets 22 which are driven by any suitable means to drive chain conveyor 20 in a clockwise direction. A reed R may be stationarily mounted by any suitable means between a harness mechanism or other apparatus for forming sheds and conveyor 20 to effect preliminary spacing of warp threads 24, 26.

At each of the shed-retaining stations, suitable apparatus may be provided for guiding a weft thread through each warp shed. In this case, the multished weaving loom is shown to include shuttle guide members 28, so as to receive therebetween and to guide a traversing shuttle which inserts weft thread in each warp shed. The shuttle guide members 28 are mounted on support frames 30 along with suitable means for beating up the weft thread, such as beat-up members 29. A detailed description is provided in U.S. Pat. No. 4,122,871. Of course, such weft thread inserting apparatus 28 and beat-up apparatus 29 are for purposes of illustration only, and it should be understood that the improved shed retainers of the present invention can be used in conjunction with any apparatus for inserting and beating up the weft thread.

Mounted for travel with guide members 28 and beat-up members 29 on support frame 30 are the improved shed retainers 32 of the present invention. As shown at station 18, retainers 32 are inserted into an open shed, so that they are generally parallel to the warp threads 24, 26, in a manner to be explained. As will also be explained herein, apparatus is provided for actuating the improved retainers 32 to the positions shown at stations 14, 16 and includes driving means 34 mounted within support frames 30.

Figure 3:
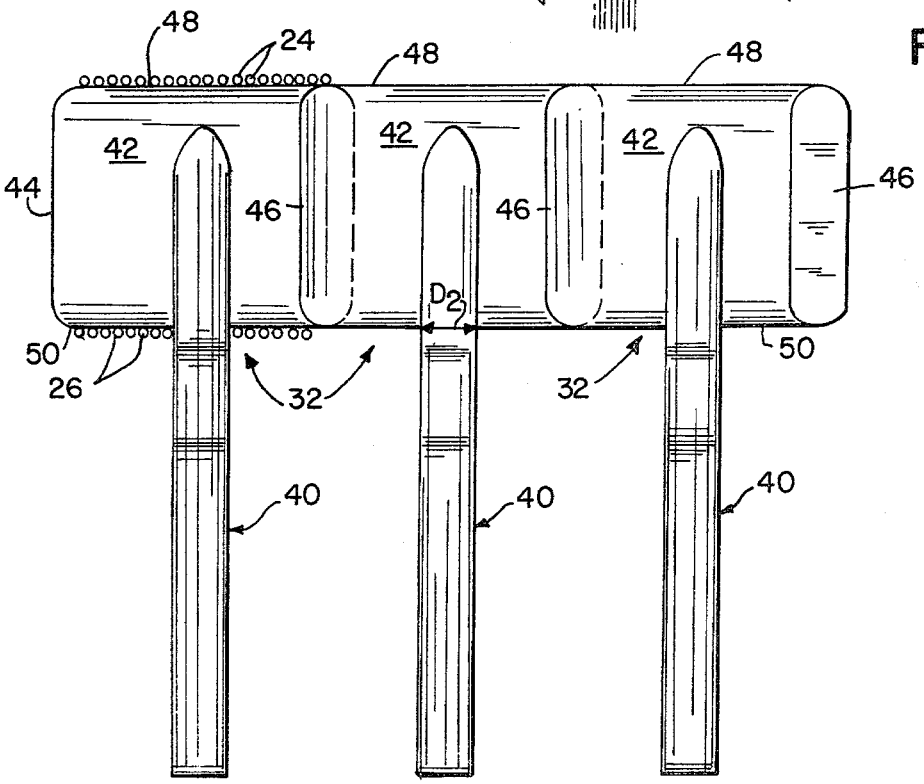
FIG. 3 is an elevational view of a plurality of shed retainers in their shed-retaining position.

Referring now to FIGS. 2 to 5, one embodiment of the improved shed retainers 32 of the present invention is illustrated. As shown therein, each shed retainer 32 includes a support member 40 and an upper plate-like member 42, which is introduced between open warp sheds generally parallel to the longitudinal axis of the warp threads. This is the release or nonholding position. The plate-like members 42 have beveled side edges 44, 46 which mate with the corresponding beveled edges of adjacent shed retainers to form a continuous wall to maintain the upper warp threads 24 and lower warp threads 26 in spaced relationship, as shown in FIG. 3. In addition, each shed retainer 32 has an upper warp thread engaging surface 48 and a lower warp thread engaging surface 50. When shed retainers are rotated 90 degrees from the shed-releasing position, shown in FIG. 2, to the shed-retaining position, shown in FIG. 3, surfaces 48, 50 form continuous parallel level surfaces for the warp threads to bear upon, with the exception of the interruptions of the lower surface 50 resulting from the connection to support members 40.

It will also be noted from FIGS. 2 to 5 that support member 40 includes an actuating shaft 58, a lower tapered section 60, a protruding section 62, and an upper tapered section 64, with the outer surface 63 of protruding section 62 and the outer surface 65 of upper tapered section 64 providing surfaces along which warp threads 24, 26 slide when they are released. In addition, when shed retainer 32 is rotated to its release position, protruding section 62 operates to increase the spacing between adjacent groups of warp threads 26 to allow shed retainers 32 to be withdrawn through the plane of the warp threads, in a manner to be explained more fully herein.

More particularly, after insertion of the shed retainers 32 between warp threads 24, 26, at the station 18, they are turned 90 degrees to the position shown at station 16, where they are in a shed-holding position, as seen in detail in FIG. 3. As each shed retainer 32 moves from station 18 to station 16, upper warp thread engaging surfaces 48 come into engagement with upper warp threads 24, and lower warp thread engaging surfaces 50 come into engagement with lower warp threads 26. The shed-retaining position of a plurality of shed retainers 32 form a continuous wall or continuous flat plate to maintain the upper warp threads in spaced relation to the lower warp threads, as shown most clearly in FIG. 3. During this time, the weft thread is inserted. This spaced relation of the warp threads and the shed-retaining position of the shed retainers 32 is maintained until a desired point is reached near the fell of the cloth, at which point the shed retainers 32 are actuated to rotate 90 degrees back to the shed-releasing position, shown in FIG. 2, to release the warp threads from surfaces 48, 50. Beat up of the weft thread, which has been inserted into each warp shed, occurs in any suitable manner after the weft thread passes station 12.

As each shed retainer 32 is turned from its shed-retaining position to its shed-releasing position, the upper and lower warp threads 24, 26 are disengaged and released in the following manner. As the shed retainers 32 begin to turn, the upper and lower surfaces 48, 50 of each shed retainer begin to release the warp threads and allow them to move towards each other toward the plane of the weft threads which have been inserted, which plane is approximately at the center of plate member 42. Accordingly, upper warp threads 24 slide downwardly along surface 65 of upper tapered section 64 and are gradually spread apart as they move downwardly along this surface. Similarly, as shed retainers 32 turn to their shed-releasing position, the lower warp threads 26 in engagement with lower warp thread engaging surfaces 50 are spread apart and slide upwardly along the outer surface 63 of protruding section 62 toward the plane of the weft threads. The spreading action of the lower warp threads 26 is caused by the fact that the dimension D2 is smaller than the dimension D1, so that as the shed retainer 32 rotates, its wider dimension D1 operates to spread the lower warp threads apart by a greater distance. In this manner, shed retainers 32 can rotate to release the warp threads without interfering with, or interference from, the warp threads bearing against its upper and lower surfaces 48, 50. In addition, shed retainers 32 can be easily withdrawn through the increased spacing D1 which is created.

Figure 6:
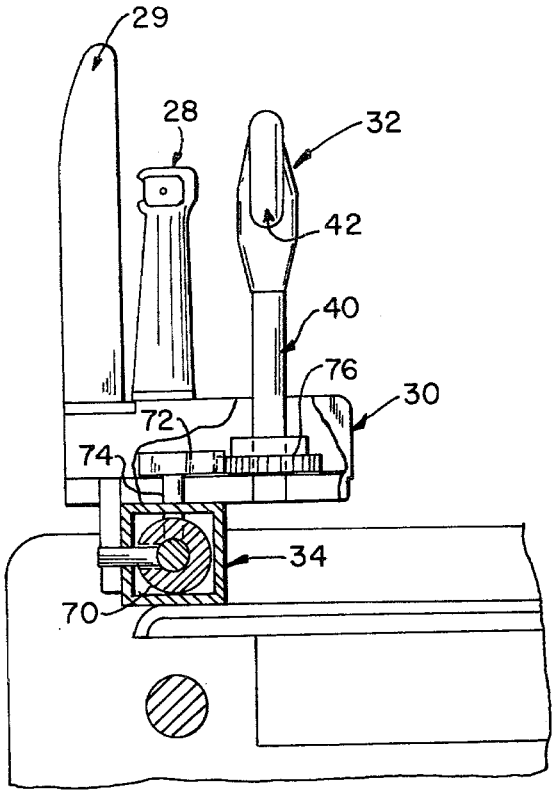
FIG. 6 is an elevational view of a shed-retaining station, with parts broken away for purposes of clarity.
Figure 7:
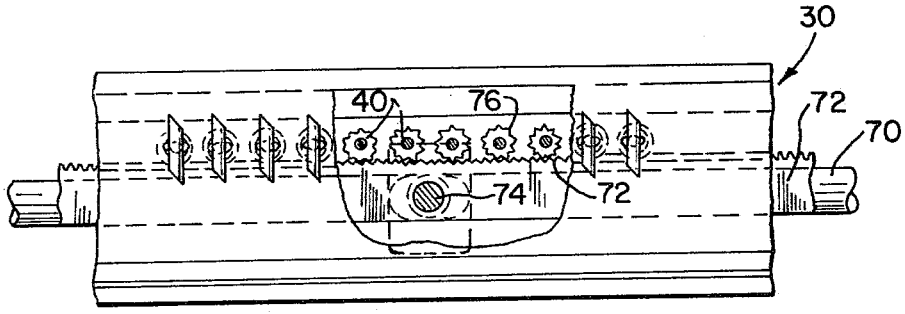
FIG. 7 is a plan view of an arrangement for actuating the shed retainers between their holding and release positions.

FIGS. 6 and 7 illustrate one suitable arrangement for effecting rotation of the releasable retainers 32 between the shed-release and shed-holding positions. Driving means 34 includes a shaft 70 which is made to reciprocate by any suitable means, such as cam means of the type shown in U.S. Pat. No. 4,122,871. Shaft 70 actuates a rack 72 by a plurality of drive pins 74 interconnecting shaft 70 with rack 72. Each rotatable support member 40 for each shed retainer 32 carries a spur gear 76 which meshes with rack 72 and is rotated thereby. Therefore, as the result of the actuation of shaft 70 and rack 72, each of the shed retainers 32 are simultaneously rotated between their shed-retaining and shed-releasing positions. For a more complete and detailed description of the operation of a suitable actuating arrangement for such shed retainers, reference is made to U.S. Pat. No. 4,122,871.

Figure 8:
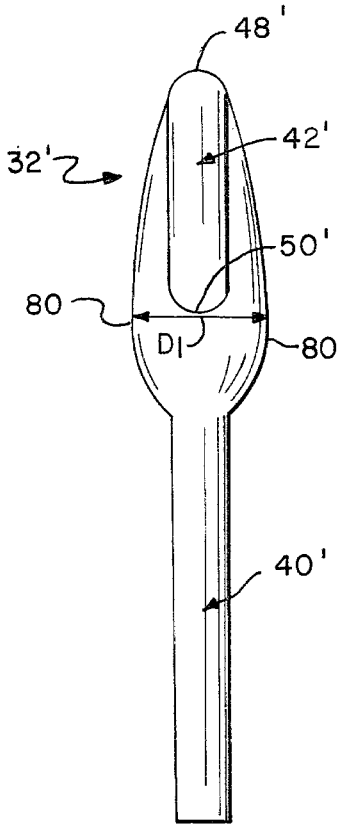
FIGS. 8 and 9 are elevation and plan views, respectively, of a modified shed retainer in accordance with the present invention.
Figure 9:
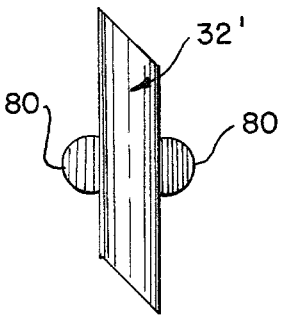

As shown in FIGS. 8 to 11, shed retainers 32 may have other configurations in accordance with the principles of the present invention. More particularly, as shown in FIGS. 8 and 9, shed retainer 32' includes warp thread engaging surfaces 80 which are substantially curvilinear in shape. In this manner, after the upper and lower warp threads are released, the upper warp threads slide downwardly along curved surface 80, while lower warp threads slide upwardly along curved surface 80 to the plane of the weft threads. Accordingly, modified shed retainer 32' operates substantially in the same manner as shed retainer 32, and also has the characteristic of having its widest dimension D1 at the point where the lower warp threads are engaged by surface 50'.

Figure 10:
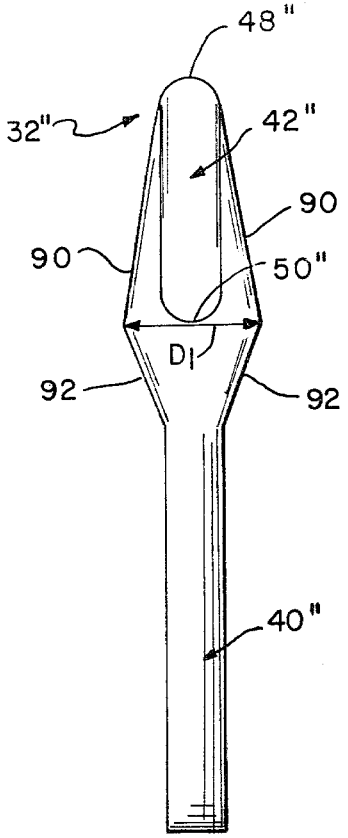
FIGS. 10 and 11 are elevation and plan views, respectivey, of a further embodiment in accordance with the present invention.
Figure 11:
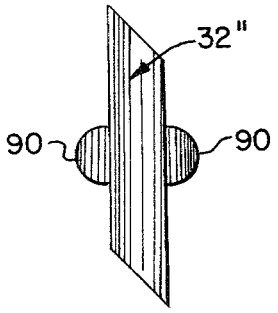

Referring now to FIGS. 10 and 11, there is shown a further alternative embodiment of the shed retainers of the present invention. In this embodiment, shed retainer 32'' includes upper tapered surfaces 90 and lower tapered surfaces 92. Upper tapered surface 90 tapers inwardly from its lower end to its upper end in a continuous straight plane or surface. Again, this modified shed retainer 32'' operates in the same manner as the above-described shed retainers. More particularly, upon rotation of the shed-retaining member 32'' to its shed-releasing position, upper warp threads slide downwardly along surface 90, and lower warp threads slide upwardly along tapered surface 90, so that upper and lower warp threads which have been released meet at the plane of the weft threads which have been inserted into the warp sheds. Accordingly, modified shed retainer 32'' operates substantially in the same manner as shed retainer 32, and also has the characteristic of having its widest dimension D1 at the point where the lower warp threads are engaged by surface 50''.

Advantageously, as a result of the present invention, improved shed retainers have been provided which positively operate to release the warp threads when the shed retainer is moved to its shed-releasing position. This is accomplished smoothly and without snagging of the warp threads and without interference with, or interference from, the warp threads which are being released. This positive releasing operation of the shed retainers of the present invention is enhanced by the provision of the enlarged or protruding warp thread engaging surfaces 63, 80, and 90 which operate to spread the warp threads apart an increased distance when the shed retainer is rotated to its shed-releasing position. By increasing the spacing between the groups of warp threads which have been released, it makes it easier to withdraw the shed retainer from the plane of the warp and weft threads forming the fabric.

As a further advantage of the present invention, the warp thread engaging surfaces 63, 80, and 90 have a substantially smaller width (D2), as compared to the width of the plate members 42 of the shed retainer. Accordingly, as it is this surface which engages the warp threads, by providing a warp thread engaging surface of a relatively small dimension, there is very little or reduced surface contact and abrasion between the shed retainers and the warp threads as the shed retainers are rotated to their shed-releasing position and moved towards the fell of the fabric and as they are withdrawn from the plane of the fabric.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A shed-retaining member for use in connection with a loom for the weaving of warp and weft threads into fabric of the type wherein said loom has a shed-forming means for elevating some of said warp threads and depressing others of said warp threads to form warp sheds, said shed-retaining member being insertable between adjacent warp threads to maintain said warp sheds, said shed-retaining member comprising:

an upper surface which in a first position is engageable with at least one elevated warp thread, and a lower surface which in said first position is engageable with at least one depressed warp thread;

means for moving said shed-retaining member to a second position in which neither said elevated warp thread nor said depressed warp thread is retained on said respective upper and lower surfaces of said shed-retaining member; and said shed-retaining member including at least one spacing surface for engagement with said warp threads to space said warp threads, said spacing surface constructed and arranged to operate to increase the spacing between groups of at least said depressed warp threads when said shed-retaining member is moved from said first position to said second position in order to release said elevated and depressed warp threads toward each other and to allow said shed-retaining member to be withdrawn from between said warp threads.

2. A shed-retaining member in accordance with claim 1, wherein said shed-retaining member includes an upper plate section, said upper surface for engaging warp threads being on the upper surface of said plate section, and said lower surface for engaging warp threads being on the lower surface of said plate section.

3. A shed-retaining member in accordance with claim 2, wherein said spacing surface for engaging the warp threads when said warp threads are released is formed on said plate section and extends out of the plane of said plate section and between said upper and lower surfaces.

4. A shed-retaining member in accordance with claim 3, wherein said spacing surface tapers inwardly toward said plate section from its lower end to its upper end.

5. A shed-retaining member in accordance with claim 3, wherein said spacing surface has a curved configuration.

6. A shed-retaining member for use in connection with a loom for the weaving of warp and weft threads into fabric of the type wherein said loom has a shed-forming means for elevating some of said warp threads and depressing others of said warp threads to form warp sheds, said shed-retaining member being insertable between adjacent warp threads to maintain said warp sheds, said shed-retaining member comprising:

an upper surface which in a first position is engageable with at least one elevated warp thread, and a lower surface which in said first position is engageable with at least one depressed warp thread;

means for moving said shed-retaining member to a second position in which neither said elevated warp thread nor said depressed warp thread is retained on said respective upper and lower surfaces of said shed-retaining member; and said shed-retaining member including at least one spacing surface for engagement with said warp threads to release said warp threads, said release surface extending out of the plane of said shed-retaining member and having a larger transverse dimension at said lower warp thread engaging surface than at said upper warp thread engaging surface.

7. A shed-retaining member in accordance with claim 6, wherein said shed-retaining member includes an upper plate section, said upper surface for engaging warp threads being on the upper surface of said plate section, and said lower surface for engaging warp threads being on the lower surface of said plate section.

8. A shed-retaining member in accordance with claim 7, wherein said spacing surface for engaging the warp threads when said warp threads are released is formed on said plate section and extends between said upper and lower surfaces.

9. A shed-retaining member in accordance with claim 8, wherein said spacing surface tapers inwardly toward said plate section from its lower end to its upper end.

10. A shed-retaining member in accordance with claim 8, wherein said spacing surface has a curved configuration, with the largest dimension of said curved surface being at said lower warp thread engaging surface.

11. A shed-retaining member in accordance with claim 6, further including a shaft section for connection to means for rotating said shed-retaining member between a shed-retaining position and a shed-releasing position.

12. A shed-retaining member in accordance with claim 6, wherein said spacing surface is constructed and arranged to operate to increase the spacing between groups of at least said depressed warp threads when said shed-retaining member is moved from said first position to said second position to release said elevated and depressed warp threads toward each other.

* * * * *

UNITED STATES PATENT AND TRADEMARK OFFICE

CERTIFICATE OF CORRECTION

PATENT NO. : 4,285,370

DATED : August 25, 1981

INVENTOR(S) : Thomas F. McGinley

It is certified that error appears in the above—identified patent and that said Letters Patent is hereby corrected as shown below:

Claim 6, column 7, line 5, change "said release" to

--said spacing--.

Signed and Sealed this

*Twenty-fifth* Day of *May 1982*

[SEAL]

*Attest:*

GERALD J. MOSSINGHOFF

*Attesting Officer*

*Commissioner of Patents and Trademarks*